US005233710A

United States Patent [19]

Bernard

[11] Patent Number: 5,233,710

[45] Date of Patent: Aug. 10, 1993

[54] COLLAPSIBLE CHILD RESTRAINER

[75] Inventor: Louise Bernard, Montreal, Canada

[73] Assignee: Yves Duquesne, Hudson, Canada

[21] Appl. No.: 995,067

[22] Filed: Dec. 22, 1992

[51] Int. Cl.[5] ..... A47C 21/08

[52] U.S. Cl. ..... 5/424; 5/93.2; 5/99.1; 5/426; 5/427

[58] Field of Search ..... 5/73.2, 99.1, 424–427, 5/658, 513, 95; 256/25

[56] References Cited

U.S. PATENT DOCUMENTS

| | | | |
|---|---|---|---|
| 2,565,988 | 8/1951 | Price . | |
| 2,665,433 | 1/1954 | Weidt | 5/99.1 |
| 2,667,647 | 2/1954 | Reggiani . | |
| 3,218,037 | 11/1965 | Corley | 5/99.1 |
| 3,221,349 | 12/1965 | Bradley | 5/658 |
| 3,261,034 | 7/1966 | Bradley | 5/658 |
| 3,708,808 | 1/1973 | Irby . | |
| 3,763,506 | 10/1973 | Szego . | |
| 3,844,471 | 10/1974 | Hind . | |
| 4,003,098 | 1/1977 | Fink . | |
| 4,178,645 | 12/1979 | Cosme . | |
| 4,233,699 | 11/1980 | Amato . | |
| 4,771,492 | 9/1988 | Paine . | |
| 4,788,726 | 12/1988 | Rafalko | 5/424 X |
| 4,833,743 | 5/1989 | Howell . | |
| 4,873,734 | 10/1989 | Pollard . | |
| 5,038,430 | 8/1991 | Bly . | |
| 5,076,546 | 12/1991 | Henry . | |
| 5,103,514 | 4/1992 | Leach . | |
| 5,115,524 | 5/1992 | Antosko . | |

FOREIGN PATENT DOCUMENTS 1235253 4/1988 Canada .

*Primary Examiner*—Michael F. Trettel
*Attorney, Agent, or Firm*—Darby & Darby

[57] ABSTRACT

The restrainer forms an elongate triangular tube with a right angle between a base panel for resting on a resting surface and a vertical panel. The vertical panel provides a child restraining wall, and the restrainer is connectable to other similar restrainers at an angle of 90 degrees to form a rectangular crib area for infants. The vertical panel is collapsible to be flat on the resting surface, and the restrainer can be put in line with another restrainer to form a longer restrainer wall for children of 18 months to 2 years.

24 Claims, 4 Drawing Sheets

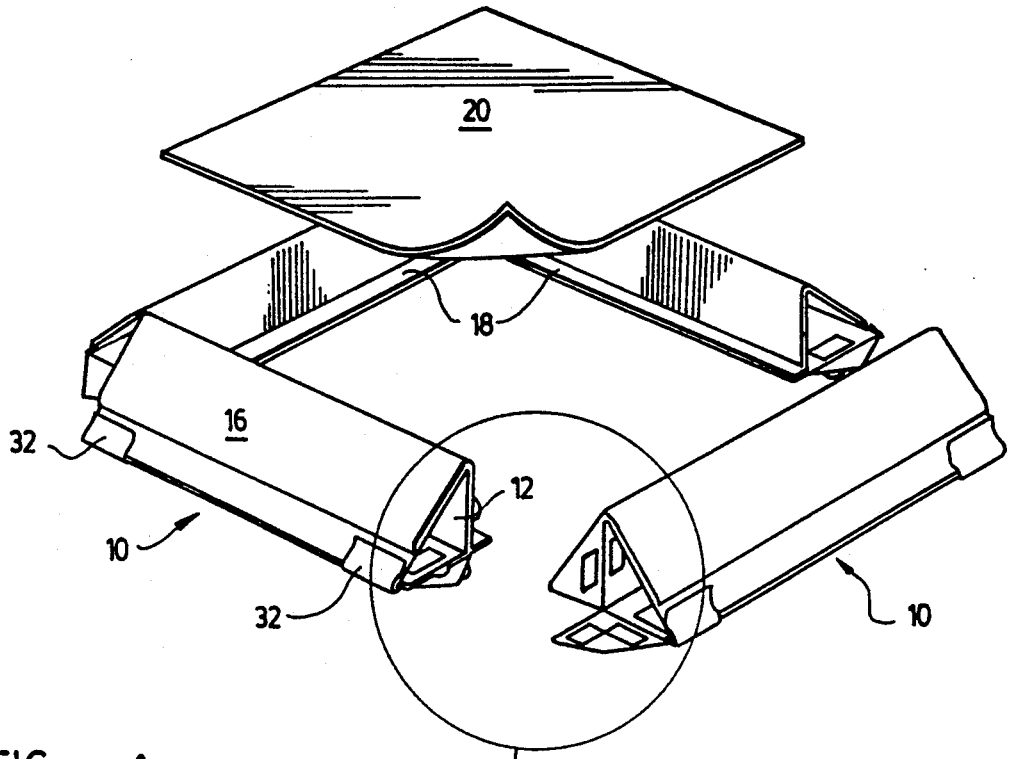
FIG. 1
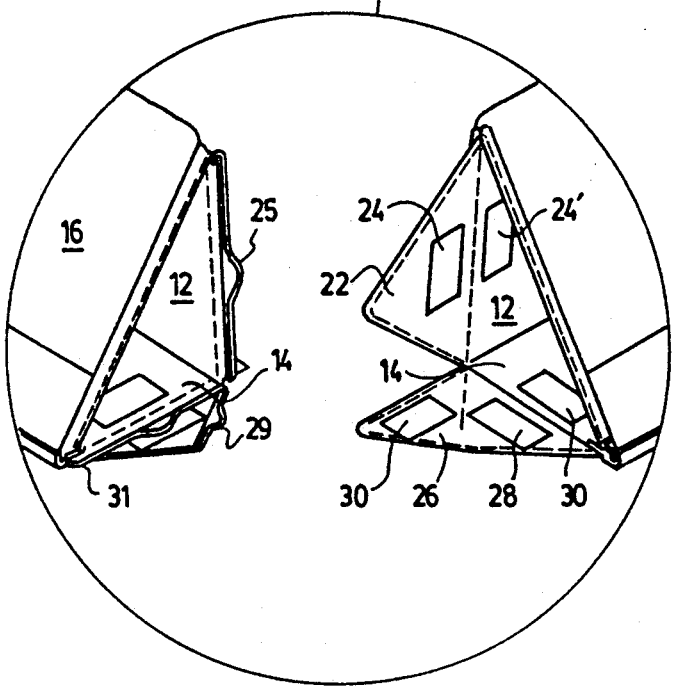

COLLAPSIBLE CHILD RESTRAINER

FIELD OF THE INVENTION

The present invention relates to a collapsible child restrainer for a child's resting surface.

BACKGROUND OF THE INVENTION

To provide resting or sleeping surfaces for infants or children, restraining walls or barriers are required to prevent the infant or child from moving off the surface. In the case of a crib, a small bed is provided with bars or netting surrounding the small bed to prevent falling off. For larger children, side rails or barriers can be attached to regular beds to prevent falling out.

There is a need for a practical child restrainer which is convenient and easy to use for day-to-day purposes. There is also a need for a child restrainer which can be easily transported and set up on any bed or resting surface for use when travelling with a child either long distance or within the same city just to visit friends.

In the prior art, a number of restrainers have been proposed. U.S. Pat. No. 5,103,514 describes an easily transportable utility pad for infants and toddlers which includes a filled, flexible, rectangular fabric tube surrounding an interior space for the infant. U.S. Pat. No. 5,115,524 describes a suitcase-style portable knock-down crib comprised of a single flat sheet of foldable material having an integrally formed rectangular base with side walls flexibly attached to the base. U.S. Pat. No. 3,708,808 describes an infant restrainer for placing on a bed which has a base and side walls associated with the base which are erected at opposite sides of the base to provide barriers against movement by the child. U.S. Pat. No. 5,076,546 describes a modular barrier and restraint for children or infants having several interchangeable panels which are interchangeable to provide different configurations including a four-walled rectangular configuration. U.S. Pat. No. 4,873,734 describes a sheet including four tubular pockets in which relatively soft yet form-retaining inserts are removably fitted to define a bumper area enclosing a sleeping or rest area within the confines of a crib, or on a bed. U.S. Pat. No. 3,844,471 describes a safety pad which can be used to prevent a baby from rolling off a supporting surface while feeding or washing the baby which comprises a padded sheet having sides and end extensions which are folded and interconnected to form lateral and end restraining means to define a rectangular resting area.

It has been found that the prior art collapsible child restrainers are not very easily or conveniently set up and collapsed for every day use. The prior art restrainers are either not very easy to transport from one place to another, or they are not easily set up and collapsed. And most importantly, the prior art restrainers are not easily adapted to be used for an infant restrainer in the configuration of a crib as well as to lateral restrainers of a greater length for one or both sides of a small child between the ages of 18 months to 4 years old.

SUMMARY OF THE INVENTION

The invention provides a collapsible child restrainer for a child's resting surface comprising a base panel having a bottom surface for resting on the child's resting surface, a vertical panel for providing a child restraining wall, collapsible means for connecting the vertical panel rigidly to the base panel with the vertical panel extending vertically with respect to the base panel and with the vertical panel being lowered and substantially parallel to the base panel, and connection means for connecting the vertical panel to a corresponding vertical panel of another restrainer at an angle of 90° whereby a rectangular resting area can be delimited by a plurality of the child restraining walls on the child's resting surface, and the resting surface can be made substantially level by collapsing the plurality of child restraining walls.

The collapsible child restrainer according to the invention may be connected to other similar restrainers for forming a rectangular crib area on a bed or the like, and also may be placed in line to provide a lateral restraining wall for preventing a small child from rolling out of a bed. Since the vertical panel is connected to the base panel using collapsible means, the vertical panels can be lowered so that the child's resting surface can be covered with sheets or blankets to make the bed without having to remove the restrainer from the resting surface. Alternatively, when the restrainer is used as part of a plurality of restrainers to form a crib area, the vertical panels can be lowered in order to give easier access to the child resting on the crib area, when for example the child needs changing or special attention.

Preferably, the connection means may comprise a bottom rectangular sheet having four sides, one of the sides being adapted to connect along its length to a length of the base panel, the other three of the sides being adapted to connect along their lengths to base panels of other restrainers, the bottom sheet thereby being able to interconnect four restrainers in a square or rectangular configuration. The restrainer may also further comprise an adjustable clamp bracket having an upper horizontal stem for engaging the base panel, an adjustable vertical stem connected to the upper horizontal stem and to a bottom horizontal stem, the bottom stem for engaging a mattress underside. In this way, the restrainer may be held on the resting surface by means of the adjustable clamp bracket without relying on the connection means when the restrainer is used as part of a lateral restraining barrier. The connection means may also comprise a strip of flexible material connected to a rear side of the vertical panel for connecting to the corresponding vertical panel. In this way, ends of the vertical panels of the plurality of restrainers forming the rectangular resting area may be interconnected by strips of flexible material. The connection means may also comprise a sheet of flexible material connected to and extending from an end of the base panel and means for fastening the sheet material to a corresponding flexible material sheet extending from a corresponding base panel of another restrainer, whereby the flexible sheet and the corresponding flexible sheet may be fastened together with the vertical panel and the corresponding vertical panel at an angle of 90°.

In its preferred form, the collapsible means may comprise a sloped panel extending between an outer edge of the base panel and an upper edge of the vertical panel. In this preferred form, the collapsible means may further comprise a hinge for connecting the sloped panel to the vertical panel and means for releasably fastening a bottom edge of the sloped panel to the outer edge of the base panel. The base panel may be provided with a groove along the base panels outer edge for receiving the lower edge of the sloped panel, and the attachment means may comprise strips of flexible material connectable by means of hook-and-loop type fasteners (e.g. Velcro (TM) brand) between the sloped panel and the base panel. The undersurfaces of the base panel and the bottom sheet may be made of a non-slip material.

BRIEF DESCRIPTION OF THE DRAWINGS

The invention will be better understood by way of the following nonlimiting description of a preferred embodiment with reference to the appended drawings in which:

FIG. 1 is a perspective view of four collapsible child restrainers and a bottom rectangular sheet above the restrainers with one of the restrainers separated from the other three;

DETAILED DESCRIPTION OF THE PREFERRED EMBODIMENT

Figure 2:
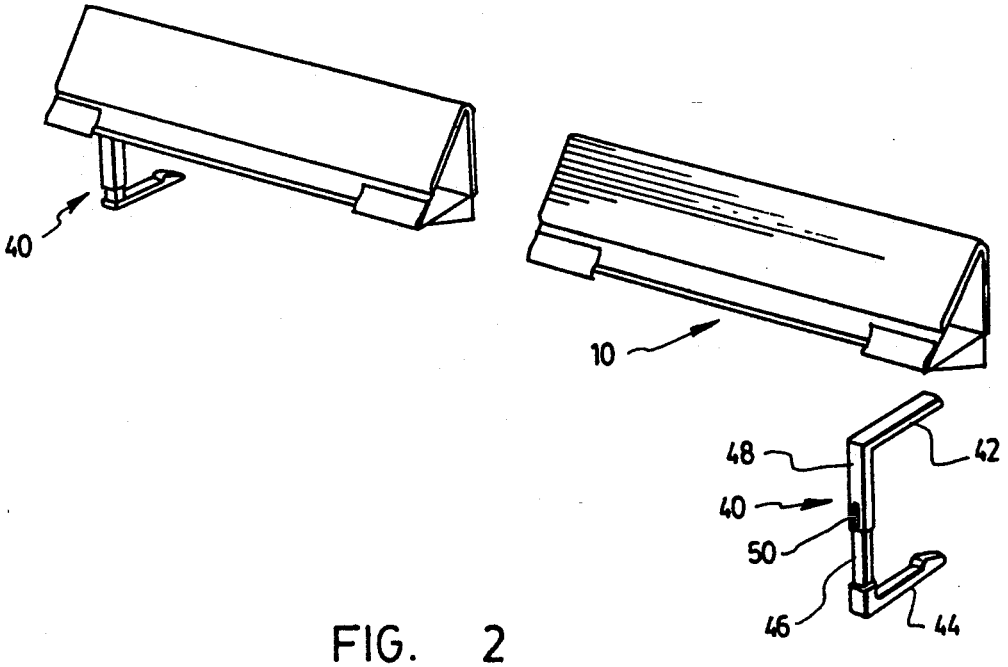
FIG. 2 shows two restrainer units about to be connected in line with one another with the adjustable clamp brackets being connected to the base panels of each restrainer.

As shown in FIG. 1, the collapsible child restrainer (10) according to the preferred embodiment comprises a vertical panel (12) for providing a child restraining wall which is articulated to a base panel (14) having a rubberized non-slip bottom surface for resting on a mattress or the like. A sloped panel (16) is articulated to the top of the vertical panel (12) for holding the vertical panel with respect to the base panel (14) at a right angle. Four restrainers (10) are shown in FIG. 1 and the restrainers (10) are interconnected in three ways.

First, a bottom sheet (20) provided with a soft upper surface and a rubberized nonslip bottom surface is provided with hook-and-loop type fasteners (commonly known by the trade mark VELCRO) around its perimeter. Complementary strips of Velcro fasteners (18) extend from the base panels (14) for attaching to bottom sheet (20) in such a way that all four retainers (10) may be held together in rectangular formation due to their connection to bottom sheet (20). Since the bottom sheet (20) is connected to the base panel (14) near the vertical panel (12), it is impossible for the infant resting on sheet (20) to place a hand or foot under the restrainer (10) in order to avoid that the infant could possibly lift the restrainer or be hurt when an adult puts weight on the restrainer with the limb caught under it.

Secondly, a sheet of flexible material such as nylon or cotton fabric (22) extends from one end of vertical panels (12) and is provided with a Velcro strip (24) on its inside surface in order to engage a complementary Velcro strip (24') on the vertical panel (12) of the same restrainer (10). The corresponding vertical panel is provided with a guide loop (25) for receiving the fabric strip (22), such that the fabric strip can be fed through the loop (25) and fastened back on the vertical panel. This keeps the vertical panels (12) interlocked. It is also worth noting that the strip of fabric (22) can be folded back and kept out of the way when not used to connect the vertical panels together.

Thirdly, similar fabric strips (26) project from one end of the base panels (14) and are provided with a Velcro fastener (28) and two complementary Velcro fastener strips (30) in order that the projecting strips (26) may be fastened to a first guide loop (29) or a second guide loop (31). Strips (26) have a right angle triangle shape in order to be foldable about a first fold line diagonally when connected in the rectangular configuration shown in FIG. 1, with the strips (26) passing through the first guide loops (29). However, in the linear configuration of FIG. 2 the strips (26) connect the restrainers (10) in a linear fashion with the strips passing through second loops (31) of other ends of the base panels (14). Similarly, the strip (22) also connects the vertical panels (12) together in the linear configuration. The combination of strips (22) and (26) provides for a good connection between two restrainers (10) without being complicated to use and expensive to manufacture.

Although the fasteners used in the preferred embodiment are of the hook and loop type (Velcro), it could also be possible to use snaps, clips or other suitable fasteners.

Figure 5:
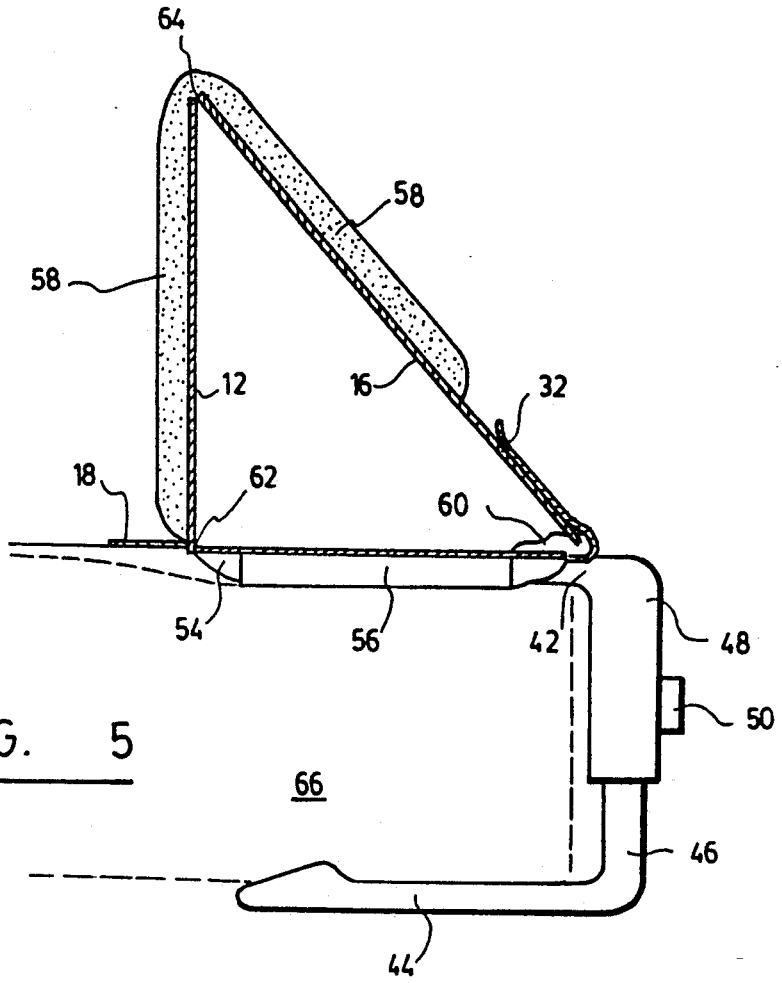
FIG. 5 shows a cross-sectional side view of the collapsible child restrainer as fitted on top of a mattress.
Figure 6:
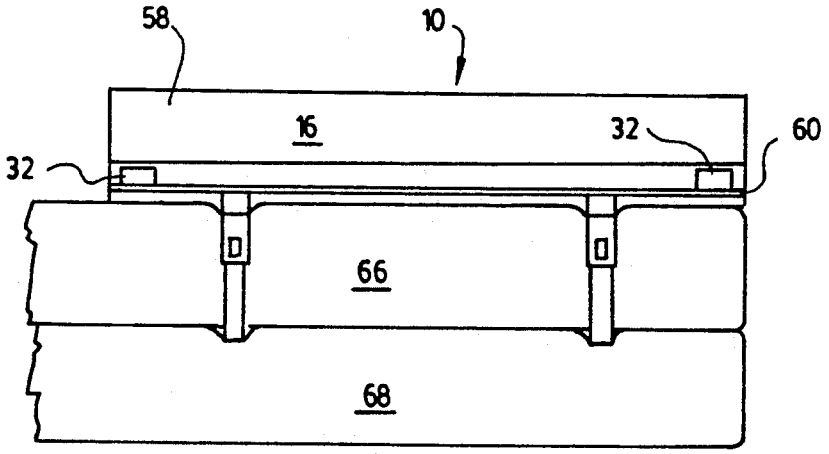
FIG. 6 shows a rear view of the collapsible child restrainer in the same set up as in FIG. 5.

With reference now to FIGS. 5 and 6 details of the construction and attachment of the child restrainer (10) according to the preferred embodiment will be given. As can be seen in FIG. 5, the sloped panel (16) is articulated to the vertical panel (12) by virtue of a fabric hinge (62), although other hinge means could equally be suitable. A foam filled fabric cushion (58) covers the vertical panel (12) and wraps around to also cover most of the sloped panel (16). The vertical panel (12) is articulated to base panel (14) using a similar fabric hinge (64). The sloped panel (16) fits into a longitudinal groove in member (60) which provides support against the vertical panel (12) being pushed outwardly by the child. A strip of fabric (32) attached to base panel (14) wraps around and is provided with Velcro fasteners on its inside in order to engage a Velcro fastener (34) provided on the outside of sloped panel (16) in order to secure the sloped panel inside member (60).

As shown in FIGS. 5 and 6, the restrainer (10) may be held in place on mattress (66) using an adjustable clamp bracket (40). The adjustable clamp bracket (40) has an upper horizontal stem (42) for engaging the base panel (14) by sliding into a rectangular tube member (56). Bracket (40) has a bottom horizontal stem (44) which is to be slid between mattress (66) and box spring (68). An adjustable vertical stem comprising an outer tube (48) and an inner member (46) along with a spring loaded release means button (50) connected to a pawl or other engaging member, allows the adjustable vertical stem to be lengthened and shortened by engaging a complementary surface on the inner member (46). With the adjustable vertical stem fully expanded, bottom horizontal stem (44) is slid between the mattress and the box spring and the upper vertical stem (42) slid into member (56) of base (14). At that point, the entire restrainer (10) is pushed down onto the mattress surface as the spring loaded pawl (50) slides over teeth angled to prevent expansion of the adjustable vertical stem until button (50) is pressed. With the clamp bracket (40) secured around mattress (66) and inserted in member (56), the restrainer (10) can be securely held in place.

Figure 3:
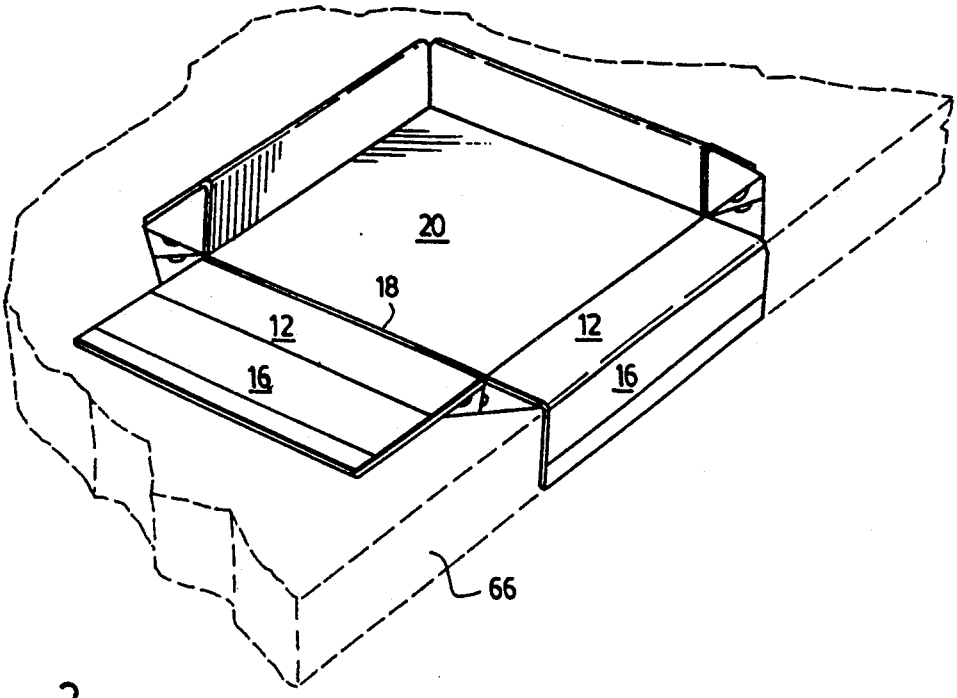
FIG. 3 shows four collapsible child restrainers connected in a rectangular configuration for forming a crib area with two of the collapsible child restrainers having the vertical panels lowered to gain straight access from the side of the bed to the rectangular resting area.

As shown in FIG. 3, four restrainers (10) are placed in a rectangular configuration on a mattress (66) to form a crib area with one restrainer near the edge of the bed. In this way, one or more of the sloped panel (16) can be brought down, and the corresponding vertical panel (12) is made to rest horizontally over the base panel (14) with the sloped panel (16) over the side of the bed or lying flat on the bed as the case may be. The connection means connecting the base panels together remain intact and the crib configuration and assembly is for the most part unaltered. Since the sloped panel (16) and the vertical panels (12) are padded, an infant from 0 to 6 months may be comfortably placed anywhere on the bed once the vertical panels are lowered without any discomfort. Furthermore, with the vertical panels lowered not only can the resting surface still be used for the infant with the guardian present to care for the infant (e.g. diaper changing) but also the restrainers (10) and resting surface can be covered with ordinary bedding in order to make the bed without having to remove the restrainers (10).

Figure 4:
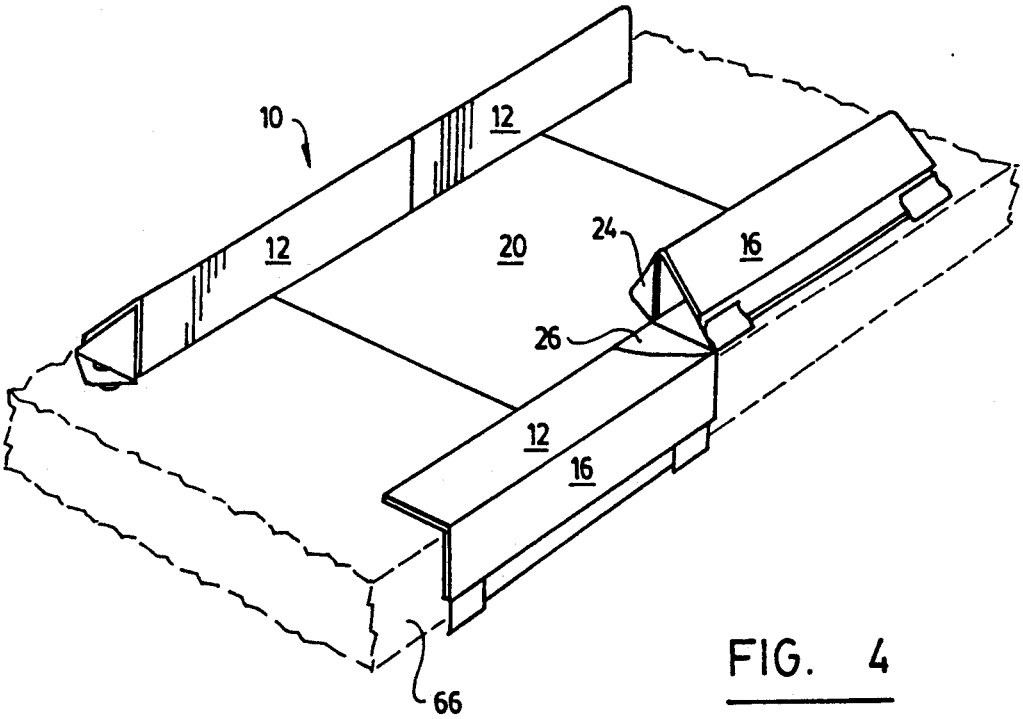
FIG. 4 shows a perspective view of four collapsible child restrainers made up of two linear pairs interconnected by the bottom rectangular sheet for forming two lateral child restraining barriers on a regular mattress.

As shown in FIG. 4, the four restrainers (10) can be arranged in two lateral pairs in order to define lateral bumpers to prevent a small child from 18 months to 4 years from rolling out of bed while sleeping. The bottom rectangular sheet (20) can be placed centrally in order to keep the pairs of restrainers (10) properly spaced and held in position, and fastening strips (22) and (26) can be used to keep the two restrainers (10) forming each linear pair well interconnected. In addition, as shown in FIG. 2, the adjustable clamp brackets (40) can be used to hold the restrainers (10) in place on the mattress without even needing the bottom rectangular sheet (20) between the linear pairs of restrainers (10). In this way, ordinary bedding such as a regular fitted sheet can be placed on the mattress (66), and the restrainers can be placed on the mattress as shown in FIG. 4 without the rectangular sheet (20), and the child can have a comfortable resting area with side bumpers (58, 12) to prevent rolling out of bed. If the mattress and box spring are placed against a lateral wall, then only two restrainers (10) would be required to prevent the child from rolling out of bed. When the morning comes and it is time to make the bed, sloped panels (16) are lowered over the side of the bed and the blankets and bed coverings can be placed over the restrainers to make an even looking made up bed without having to remove the restrainers (10) from the bed.

Of course, it is important that the clamp brackets (40) hold the base panels (14) on the mattress (66) in such a position that hinge (62) is located on mattress (66) at a distance from its side edge which is just slightly less than the distance between hinge (62) and hinge (64) so that sloped panel (16) hangs over the side of mattress (66) covering the adjustable vertical stems of brackets (40). Hinge (64) is a fabric hinge which can be folded along with cushion (58) such that vertical panel (12) rests on top of sloped panel (16) (itself resting on base panel (14)) to provide a convenient compact arrangement for storage or transportation. Of course, if this were not the case it would be possible to fold the vertical panel (12) forwardly causing hinge (64) to completely close its angle for making the restrainer (10) rest flat on the mattress (66).

What is claimed is:

1. A collapsible child restrainer for a child's resting surface, comprising:

a base panel having a bottom surface for resting on said resting surface;

a vertical panel for providing a child restraining wall;

collapsible means for connecting the vertical panel rigidly to the base panel with the vertical panel extending vertically with respect to the base panel, and with the vertical panel being lowered and substantially parallel to the base panel; and connection means for connecting the vertical panel to a corresponding vertical panel of another restrainer at an angle of 90°, whereby a rectangular resting area can be delimited by a plurality of said walls on said resting surface, and said resting surface can be made substantially level by collapsing the plurality of said walls.

2. Restrainer as claimed in claim 1, wherein said connection means comprise a bottom rectangular sheet having four sides, one of said sides being adapted to connect along its length to a length of the base panel, the other three of said sides being adapted to connect along their lengths to base panels of other restrainers, said bottom sheet thereby being able to interconnect four restrainers in a rectangular configuration.

3. Restrainer as claimed in claim 2, wherein said bottom rectangular sheet is provided with a non-slip undersurface.

4. Restrainer as claimed in claim 2, wherein said connection means connect the bottom rectangular sheet to the base panel near the vertical panel, whereby the child resting on the bottom sheet cannot place a limb under the base panel.

5. Restrainer as claimed in claim 1, further comprising an adjustable clamp bracket having an upper horizontal stem for engaging the base panel, an adjustable vertical stem connected to the upper horizontal stem and to a bottom horizontal stem, the bottom stem for engaging a mattress underside.

6. Restrainer as claimed in claim 5, wherein the adjustable vertical stem comprises a first member slideable in a second member, push button means cooperating between the first and second members to prevent expansion of the vertical stem except when the push button means is pressed and to allow contraction of the vertical stem, whereby the clamp bracket can be clamped on a mattress side by pressing the upper and bottom horizontal stems together and released by pressing the push button means and separating the upper and bottom horizontal stems.

7. Restrainer as claimed in claim 1, wherein said connection means comprise a strip of flexible material connected to and extending from a rear side of one end of the vertical panel, and means for connecting the flexible material strip to the corresponding vertical panel.

8. Restrainer as claimed in claim 7, wherein said strip of flexible material is provided with a fastener for connecting to a complementary fastener provided on said one end, such that said strip of flexible material may be fed through a guide loop provided at an end of the complementary vertical panel with the fastener connected to the complementary fastener for securing said vertical panel to the corresponding vertical panel, and the fastener may be connected to the complementary fastener when the strip of flexible material is not to be connected to the guide loop to store the strip of flexible material 9. Restrainer as claimed in claim 7, further comprising a guide loop provided at an opposite end of said vertical panel for receiving a strip of flexible material from the corresponding vertical panel for securing said vertical panel to the corresponding vertical panel.

10. Restrainer as claimed in claim 1, wherein said connection means comprise a sheet of flexible material connected to and extending from an end of the base panel and means for fastening said sheet material to a corresponding flexible material sheet extending from a corresponding base panel of another restrainer, whereby said flexible material sheet and said corresponding flexible material sheet may be fastened together with the vertical panel and the corresponding vertical panel at an angle of 90°.

11. Restrainer as claimed in claim 10, wherein said flexible material sheet has an extension portion with substantially a right angle triangular shape with its base along said base panel end and its right angle at the vertical panel, a first fastener provided on said extension portion near said triangle base, a second complementary fastener provided near an apex of said extension portion for connecting to said first fastener when said sheet is folded over about a first fold line with said apex being substantially over said triangle base opposite said right angle, and a third complementary fastener provided on said base panel for connecting to said first fastener as said extension portion is folded about a second fold line over said base panel, whereby when the corresponding flexible material sheet is provided with a first guide loop for receiving said flexible material sheet for folding about said first fold line, said base panel may be connected to said corresponding base panel with the vertical panels raised, in abutment and at an angle of 90°, and when the corresponding base panel has a second guide loop for receiving said flexible material sheet for folding about said second fold line, said base panel may be connected to said corresponding base panel with their ends in abutment and in line.

12. Restrainer as claimed in claim 10, wherein said flexible material sheet is provided with a first guide loop extending from said end of said base panel near the vertical panel at an acute angle with respect to said end of said base panel and a fastener for connecting to a complementary fastener provided on said base panel, further comprising a second guide loop provided along said end of said base panel, whereby when said corresponding flexible material sheet has an extension portion with substantially a right angle triangular shape with its base along said corresponding base panel end and its right angle at a corresponding vertical panel, a first fastener provided on said extension portion near said triangle base, a second complementary fastener provided near an apex of said extension portion for connecting to said first fastener when said extension portion is folded over about a first fold line with said apex being substantially over said triangle base opposite said right angle, and a third complementary fastener provided on said corresponding base panel for connecting to said first fastener as said extension portion is folded about a second fold line over said base panel, the corresponding flexible material sheet may be fed through said first guide loop for folding about said first fold line for connecting said base panel to said corresponding base panel with the vertical panels raised, in abutment and at an angle of 90°, and the corresponding flexible material sheet may be fed through said second guide loop for folding about said second fold line for connecting said base panel to said corresponding base panel with their ends in abutment and in line.

13. Restrainer as claimed in claim 1, wherein said collapsible means comprise a sloped panel connectable between an outer edge of the base panel and an upper edge of the vertical panel.

14. Restrainer as claimed in claim 13, wherein the collapsible means further comprise a hinge for connecting the sloped panel to the vertical panel, and means for releasably fastening a bottom edge of the sloped panel to said outer edge of the base panel.

15. Restrainer as claimed in claim 14, wherein the base panel is provided with a groove along said outer edge for receiving the lower edge of the sloped panel, and said fastening means comprise strips of flexible material connected to the base panel, said strips being provided with fasteners for connecting to complementary fasteners provided on the sloped panel.

16. Restrainer as claimed in claim 14, wherein a height of the vertical panel is greater than a width of the base panel, whereby when the bottom surface of the base panel is resting on an edge of a bed, the vertical panel can hang over the edge of the bed.

17. Restrainer as claimed in claim 14, further comprising an adjustable clamp bracket having an upper horizontal stem for engaging the base panel, an adjustable vertical stem connected to the upper horizontal stem and to a bottom horizontal stem, the bottom stem for engaging a mattress underside.

18. Restrainer as claimed in claim 14, wherein said connection means comprise a strip of flexible material connected to a rear side of the vertical panel for connecting to the corresponding vertical panel.

19. Restrainer as claimed in claim 14, wherein said connection means comprise a sheet of flexible material connected to and extending from an end of the base panel and means for fastening said sheet material to a corresponding flexible sheet extending from a corresponding base panel of another restrainer, whereby said flexible sheet and said corresponding flexible sheet may be fastened together with the vertical panel and the corresponding vertical panel at an angle of 90°, or with the vertical panel and corresponding vertical panel in line and in abutment.

20. Restrainer as claimed in claim 14 , wherein said connection means comprise a bottom rectangular sheet having four sides, one of said sides being adapted to connect along its length to a length of the base panel, the other three of said sides being adapted to connect along their lengths to base panels of other restrainers, said bottom sheet thereby being able to interconnect four restrainers in a rectangular configuration.

21. Restrainer as claimed in claim 14, wherein said hinge allows the sloped panel to be folded over the vertical panel when the vertical panel is folded down on the base panel, whereby a compact arrangement is provided for transport.

22. Restrainer as claimed in claim 14, further comprising a cushion connected to and covering the vertical panel and at least an upper part of the sloped panel.

23. Restrainer as claimed in claim 22, wherein a height of the vertical panel is greater than a width of the base panel, whereby when the bottom surface of the base panel is resting on an edge of a bed, the vertical panel can hang over the edge of the bed.

24. Restrainer as claimed in claim 1, wherein said base panel is provided with a non-slip undersurface.

* * * * *